United States Patent [19]

Sassaman et al.

[11] 4,042,994

[45] Aug. 23, 1977

[54] SWEEPER ASSEMBLY

[75] Inventors: David S. Sassaman, Oshkosh; Raymond F. McDonald, Winneconne, both of Wis.

[73] Assignee: J. I. Case Company, Racine, Wis.

[21] Appl. No.: 654,248

[22] Filed: Jan. 30, 1976

[51] Int. Cl.[2] ..... E01H 1/04

[52] U.S. Cl. ..... 15/83; 15/79 R

[58] Field of Search ..... 15/79 R, 79 A, 83, 84, 15/340, 85, 86

[56] References Cited

U.S. PATENT DOCUMENTS

| | | | |
|---|---|---|---|
| 2,448,328 | 8/1948 | Russell | 15/83 |
| 3,591,883 | 7/1971 | Armstrong | 15/79 R |
| 3,823,435 | 7/1974 | Rhodes et al. | 15/79 R |

FOREIGN PATENT DOCUMENTS

| | | | |
|---|---|---|---|
| 454,105 | 1/1949 | Canada | 15/83 |
| 501,386 | 4/1920 | France | 15/83 |

*Primary Examiner*—Edward L. Roberts
*Attorney, Agent, or Firm*—Cullen, Settle, Sloman & Cantor

[57] ABSTRACT

An improved sweeper assembly having a pair of oppositely rotatable brushes supported in spaced parallel relation within a housing enclosure. A lower baffle plate is provided forward of the lower brush which defines an expanding throat for the housing. Particulate material is swept by the lower brush, through the throat opening and then propelled by the upper brush out of the housing into a collection hopper. The lower baffle also includes a downwardly facing arcuate lower end, which is spaced below the rotational axis of the lower brush and which serves as a drag plate, limiting the material swept by the lower brush. The brushes are driven by rotation of the ground supporting wheels at predetermined speeds to improve the collection capacity of the sweeper assembly.

8 Claims, 4 Drawing Figures

SWEEPER ASSEMBLY

FIELD OF THE INVENTION

The present invention relates generally to rotary brush sweepers, such as lawn sweepers, which may be pulled, towed by a vehicle or drawn by hand. More particularly, the sweeper of this invention has an improved baffle assembly and drag plate which provides optimum collection capabilities, while avoiding clogging.

DESCRIPTION OF THE PRIOR ART

The sweepers shown by the relevant prior art generally include a ground engaging a rotary sweeper brush and an oppositely rotating brush or impeller which receives the particulate material from the sweeper brush and propels the material into a hopper or the like. See for example U.S. Pat. No. 3,823,435, which is assigned to the Assignee of the present invention and is incorporated herein by reference.

In the prior art, the oppositely rotating brushes or impellers are confined in a downwardly opening housing or chamber which may include an upper baffle generally conforming to the upper surface of the brushes. The particulate material is swept upwardly by the sweeper brush and thrown into the path of the oppositely rotating secondary brush or impeller. The particulate material is then propelled over the secondary brush or rotor into a hopper or bag. For optimum operation of the sweeper, the particulate material should be received on the secondary brush generally at the rotary speed of the brush and the quantity of the particulate material should be metered or controlled to avoid clogging. The prior art does not include any means to control either the speed or quantity of the particulate material received in the housing and therefore the housing may be easily clogged during normal operation. For example, the housing may be clogged when the sweeper is run over an accumulation of pile of particulate material, such as clippings or leaves.

SUMMARY OF THE INVENTION

As disclosed in the above referenced patent of Rhodes et al, the sweeper assembly of this invention may include a downwardly opening housing enclosure having a rotatably mounted sweeper brush, a second brush rotatably mounted within the housing adjacent and above the sweeper brush and means rotating the brushes, preferably in opposite directions. The sweeper brush will thereby deliver particulate material to the second brush, which propels the material out of the housing into a suitable hopper, bag or the like. The sweeper assembly of the present invention includes a lower baffle which defines a throat between the sweeper brush and the housing directing particulate material collected by the sweeper brush into the housing enclosure, toward the secondary brush. In the preferred embodiment, the lower baffle also includes a lower end which is adapted to lift the sweeper assembly and the lower brush upon engaging accumulated particulate material, to limit the material received in the throat, thereby preventing clogging of the sweeper assembly. The lower baffle end is preferably arcuate to provide a drag surface spaced below the rotational axis of the sweeper brush.

The preferred embodiment of the lower baffle includes an arcuate face confronting the sweeper brush, defining an expanding throat entering the housing enclosure and between the rotary brushes. The path of the particulate material then proceeds over the second rotary brush which propells the material out of the housing enclosure. In the disclosed embodiment, the housing includes an upper baffle which receives the particulate material from between the brushes and which defines the outlet of the housing enclosure.

As described above, the primary object of the present invention is to optimize the operation of a rotary brush sweeper, while avoiding clogging. The lower baffle in the sweeper assembly of the prevent invention provides an expanding throat into the housing enclosure and an arcuate drag plate which improves the operation of the sweeper, while avoiding clogging. It has been found that the operation of the sweeper may be further optimized by the location of the drag surface of the lower baffle and by controlling the rotational speeds of the brushes. In the preferred embodiment, the arcuate lower baffle end is spaced below the rotational axis of the sweeper brush a distance greater than one-half the radius of the sweeper brush. The sweeper brush is preferably rotated at a ratio of about 5:1 to 7:1 the rotational speed of the wheels and the second brush is rotated at a ratio of about 1.5:1 to 2:1 of the rotational speed of the sweeper brush.

Further objects and meritorious features of the present invention will be more fully understood from the description of the preferred embodiment the appended claims and the drawings, a brief description of which follows.

DESCRIPTION OF THE PREFERRED EMBODIMENTS

Figure 2:
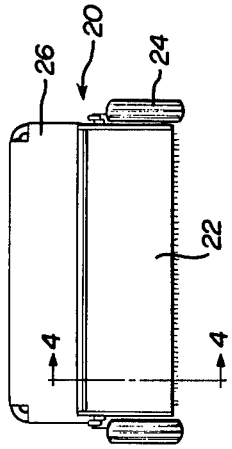
FIG 2 is a front elevation of the sweeper assembly shown in FIG. 1.
Figure 1:
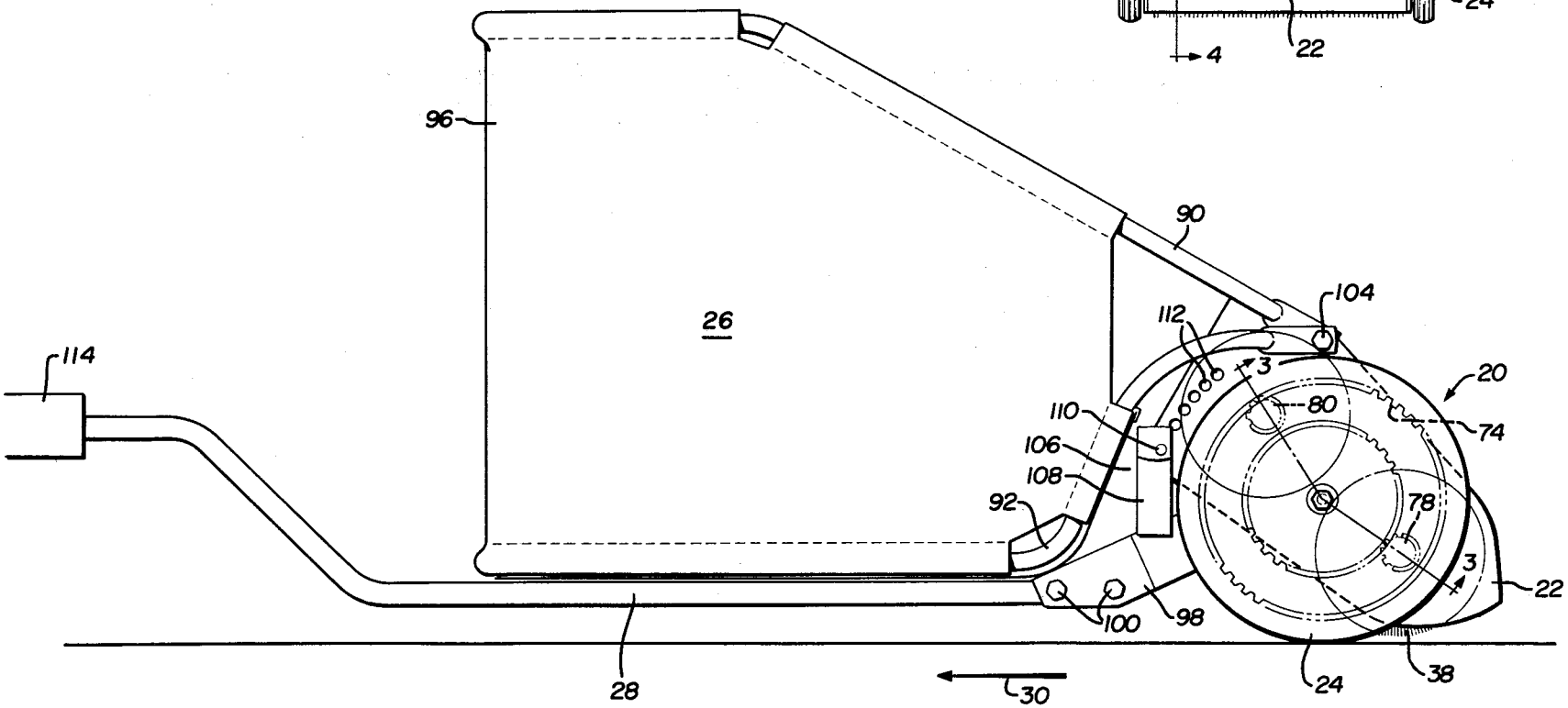
FIG. 1 is a side elevation of one embodiment of the sweeper assembly of this invention.

The sweeper assembly 20 shown in FIGS. 1 and 2 includes a housing enclosure 22, ground engaging and supporting wheels 24, a collection hopper 26 and a draw bar assembly 28. As described below, the draw bar assembly may be connected to a tractor or other vehicle to pull the sweeper assembly along the ground in the direction of arrow 30. The movement of the sweeper assembly in the direction of arrow 30 causes rotation of the rotary brushes within the housing enclosure to sweep particulate material, such as leaves, clippings, etc., which are then collected in the hopper 26.

Figure 4:
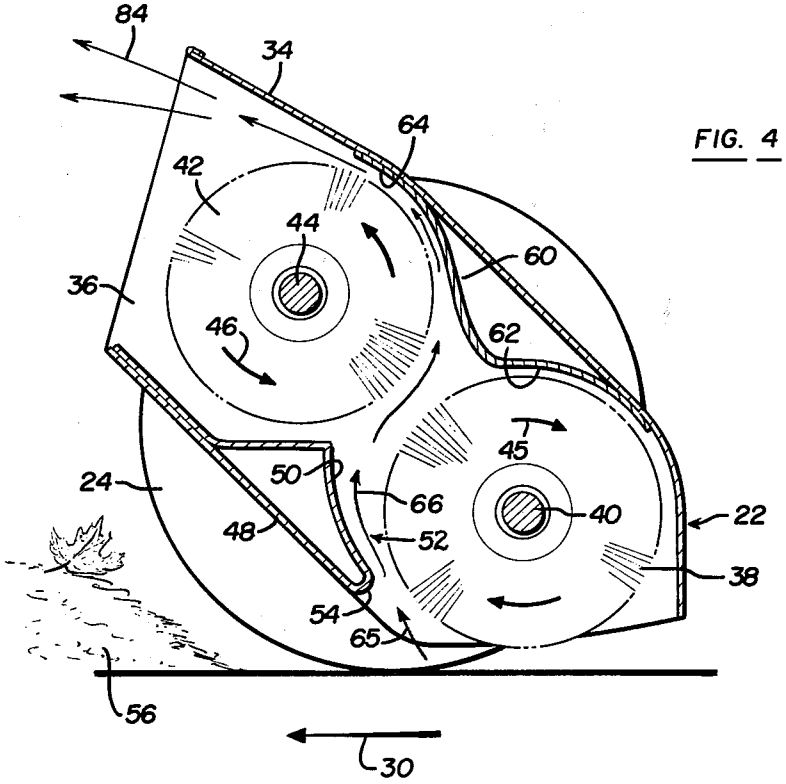
FIG. 4 is a side cross-sectional view of the sweeper assembly shown in FIG. 2, in the direction of view arrows 4—4.

The construction of the housing assembly is best shown in FIG. 4. The housing is a downwardly facing enclosure having a top wall 34 and opposed side walls 36. A sweeper brush 38 is rotatably supported within the housing on shaft 40, which is perpendicular to the side walls 36. A second rotary brush 42 is rotatably supported on shaft 44 located forward and above sweeper brush 38. As used herein, "forward" refers to the direction of arrow 30. As shown by arrows 45 and 46, the sweeper brush 38 is rotated in clockwise direction to sweep the particulate material upwardly as the sweeper assembly is moved in the direction of 30. The second rotary brush 42 is oppositely rotated in a counter clockwise direction to propel the particulate material into the hopper, as described hereinbelow.

The lower baffle assembly 48 in the preferred embodiment includes an arcuate face 50 confronting the sweeper brush 38 which defines an expanding throat 52 into the housing enclosure and between the rotary brushes 38 and 42. As described above, the arcuate lower edge 54 of the lower baffle defines a drag surface which limits the sweeping capacity of sweeper brush 38 and therefore limits clogging of the sweeper assembly. The drag face is preferably spaced below the rotational axis 40 of the sweeper brush a distance greater than one-half the radius of the sweeper brush. For example, when the sweeper assembly is drawn over an accumulation of particulate material, such as a pile of cuttings or leaves 56, the drag face 54 raises the sweeper assembly and lower brush 38 to limit the amount of particulate material swept into the throat 52.

The upper baffle plate 60 includes an arcuate portion 62 confronting the sweeper brush 38 and an arcuate portion 64 confronting the second rotary brush 42 and defining a decreasing throat between the brush and the baffle.

Particulate material is thereby swept upwardly by the rotating sweeper brush 38 into the expanding throat 52 as shown by arrow 65. As described, the lower baffle is designed to achieve maximum air flow. This results in maximizing material transfer from the sweeper or primary brush 38 to the second rotary brush 42. This optimum air flow is achieved by providing a large air volume in the interchange area between the sweeper and second rotary brushes at arrows 66 and a minimum area or reducing throat between the second rotary brush 42 and the upper baffle face 64. The combination of the lower baffle edge 54 and the expanding throat 52 thereby optimizes the operation of the sweeper assembly of this invention, while limiting clogging.

To achieve maximum material transfer utilizing only the tractive work available from the wheels and ground contact, the secondary brush 42 is preferably driven faster than the primary or sweeper brush 38 at a ratio of about 1.5:1 to 2:1. This ratio has been found to be best for discharging the particulate material into the hopper at a sufficient speed to insure that the material hits the outer walls to achieve maximum filling of the hopper. The sweeper brush is preferably rotated at a ratio of about 5:1 to 7:1 the rotational speed of the wheels to provide the necessary torque to minimize clogging. In one example, these ratios would result in a secondary brush speed of about 700 rpm, a sweeper brush speed of about 500 rpm and a ground speed of about 3 miles per hour.

Figure 3:
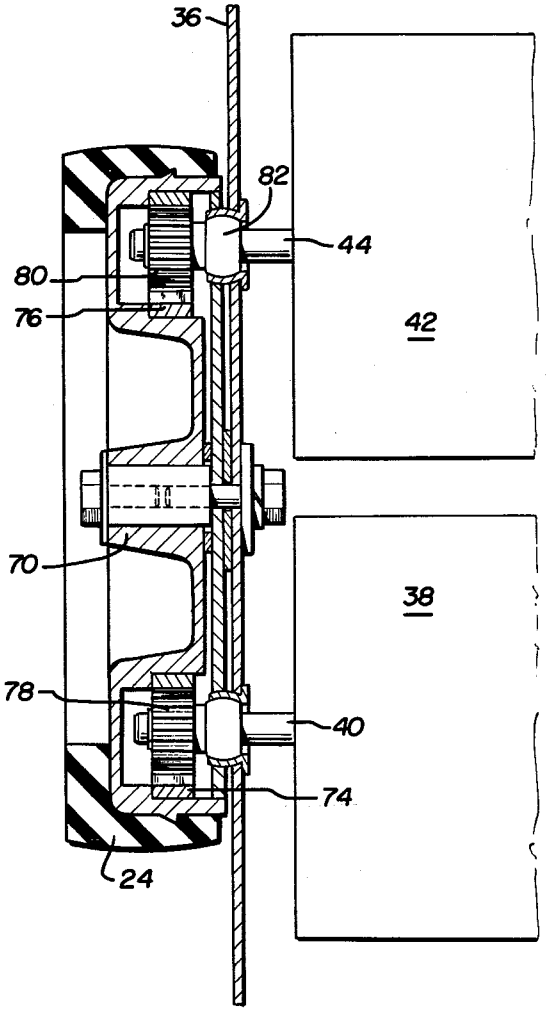
FIG. 3 is a partially cross sectioned bottom view of the drive means for the rotary brushes shown in FIG. 1, in the direction of view arrows 3—3.

A suitable drive means for the sweeper and second rotary brush is shown in FIG. 3. This is a positive drive means which is disclosed in the above referenced patent of Rhodes et al assigned to the Assignee of the instant application. Briefly, the drive means includes a metal hub 70 which is retained within one of the ground supporting wheels 24 of the sweeper assembly. The hub includes an annular channel 72 concentric with the wheel having an outer planatary gear 74 on the radial outer wall and an inner planatary gear 76 on the radial inner wall. The shaft 40 of the sweeper brush 38 includes a pinion gear 78 which engages the inner planatary gear and the shaft 44 of the second rotary brush 42 includes a pinion gear 80 which engages the outer planatary gear 74. The brushes are thus driven in opposite directions with the second rotary brush 42 driven at a greater speed than the sweeper brush. As described above, the second brush of the present invention is preferably driven at a ratio of about 1.5:1 to 2:1 of the rotational speed of the sweeper brush. In the disclosed embodiment, the brush shafts 40 and 44 are supported in bearings 82 in the side wall 36 of the housing. Other details of the positive drive are more fully disclosed in the above referenced patent of Rhodes et al.

It will be understood that the sweeper assembly of this invention may utilize any conventional drive means for the brushes, although a positive drive means is preferred to accurately drive the brushes at the preferred speed ratios. For example, an impositive drive, such as a belt drive may be utilized.

As will now be understood, the particulate material swept by the rotary brush assembly is propelled by the second rotary brush 42 into a hopper as shown by arrows 84 in FIG. 4. A suitable hopper assembly is best shown in FIG. 1. The disclosed hopper assembly includes a U-shaped upper tubular frame member 90 and a U-shaped lower tubular frame member 92 which define the shape of the hopper assembly 26. A cover 96 is stretched over the upper and lower frame members, which may be sewn into place as shown. A suitable cover material would be canvas or the like. As shown, the hopper is supported on the opposed draw bar arms 28.

The opposed draw bar arms 28 are connected to the stationary frame member 98 by bolts 100 or the like. The stationary frame members may be connected to the supporting wheels 24 as shown in FIG. 3 and described in the above referenced patent of Rhodes et al. As described in the Rhodes et al patent, the hopper 26 may be rotated over the sweeper assembly to unload the hopper and the sweeper housing may be rotated about the wheel axis to change the angular position of the sweeper brush 38, particularly to raise the sweeper brush during transportation. In the disclosed embodiment, the upper and lower frame members 90 and 92 are pivotally connected to the side walls of the housing by pivot 104. As described, the frame members are generally U-shaped, such that the opposed ends of each of the frame members are connected to opposite sides of the sweeper housing.

The angular position of the sweeper assembly housing may be adjusted in the disclosed embodiment by latch means 106. The latch means includes a bracket 108 connected to the stationary frame member 98 and a latch pin 110 which is selectively received in one of a plurality of apertures or holes 112 in the side wall of the housing. The position of the sweeper brush 38 may therefore be adjusted simply by releasing the latch pin 110 and rotating the housing to the desired position. The latch pin is then reinserted in one of the apertures 112, locking the sweeper assembly housing and the sweeper brush 38 in the desired position.

As understood from the above description, the sweeper assembly of this invention may be drawn in the direction of arrow 30 by connecting the draw bar arms 28 to a suitable tractor or other conveyance. A tow bar bracket is shown schematically at 114. The movement of the sweeper assembly in the direction of arrow 30 rotates the ground supporting wheels 24 in a clockwise direction, which rotates the brushes 38 and 42 in opposite directions as shown in FIG. 4. The particulate material which is to be collected is swept upwardly by the sweeper brush 38 as shown by arrow 65, into the expanding throat 52. The particulate material is then received by the second rotary brush 42, propelled through the reducing throat between the upper baffle 60 and the second rotary brush, and finally into the hopper as shown by arrows 84. As described, the baffle design of the present invention maximizes air flow through the housing chamber, optimizing the flow of particulate material from the sweeper brush into the hopper. Further, the arcuate lower end 54 serves as a drag surface to avoid sweeping an accumulation of particulate material into the hopper which would result in clogging of the hopper assembly. The sweeper assembly of the present invention therefore results in several advantages which are not found in the prior art and which are important to efficient operation of a sweeper assembly.

It will be understood that modifications may be made to the sweeper assembly of the present invention without departing from the purview of the appended claims. For example, the positive driven shown in FIG. 3 may be replaced with a more conventional impositive drive, such as a belt drive. Similarly, various hooper designs may be utilized depending upon the particular application of the sweeper assembly of this invention. Having described one embodiment of the sweeper assembly of this invention, there follows the claims of the invention.

We claim:

1. A sweeper assembly, comprising:

a downwardly opening housing enclosure, a rotary sweeper brush rotatably mounted within said housing, a second rotary brush rotatably mounted within said housing generally parallel to said sweeper brush located adjacent and above said sweeper brush, means rotating said brushes to lift particulate material swept by said sweeper brush and propelled by said second brush through an opening said housing, a lower baffle means having an arcuate face spaced from and confronting said sweeper brush defining a throat between said sweeper brush and said housing directing particulate material collected by said sweeper brush into said housing enclosure, toward said secondary brush, and said lower baffle having a lower edge fixed relative to said housing and spaced below the rotational axis of said sweeper brush with said rotary brush spaced below said lower end, said baffle means lower end adapted to lift said sweeper assembly and lower brush upon engaging accumulated particulate material to limit the material received through said throat into said housing and prevent clogging of said sweeper assembly.

2. The sweeper assembly defined in claim 1, characterized in that said lower baffle end is arcuate and faces downwardly to provide a ground engaging end.

3. The sweeper assembly defined in claim 2, characterized in that said lower baffle end is spaced below the rotational axis of said sweeper brush a distance greater than one-half of the radius of said sweeper brush.

4. A sweeper assembly comprising:

a downwardly opening housing enclosure having a top and side walls, ground traversing wheels supporting said housing for movement along the ground, a rotary sweeper brush rotatably mounted within said housing generally perpendicular to said side walls, a second rotary brush rotatably mounted within said housing generally parallel to said sweeper brush, said second rotary brush located above and forward of said sweeper brush, means rotating said brushes to sweep particulate material into said housing, said particulate material propelled by said second rotary said brush through a housing opening and a lower baffle enclosing the forward end of said housing extending between said side walls, said baffle having an arcuate face confronting said sweeper brush and spaced closer to said sweeper brush adjacent the opening to said housing defining an expanding throat opposite said sweeper brush directing particulate material from said sweeper brush to said second brush and said baffle having an arcuate lower end fixed relative to said housing facing downwardly and spaced below the rotational axis of said sweeper brush forming a drag surface for said housing, said sweeper brush spaced below said baffle lower end whereby said arcuate baffle surface will lift said sweeper assembly and brush to limit the particulate material received within said housing and prevent clogging.

5. The sweeper assembly defined in claim 4, characterized in that said lower baffle includes an arcuate face confronting said sweeper brush defining said throat, said arcuate face extending from said lower end away from said sweeper brush defining an expanding throat and limiting clogging of said sweeper assembly.

6. A sweeper assembly comprising:

a downwardly opening housing having side walls, a rotary sweeper brush rotatably mounted within said housing generally perpendicular to said side walls and extending below said side walls to sweep particulate material into said housing, a second rotary brush rotatably mounted within said housing generally parallel to said sweeper brush in spaced relation forward and above said sweeper brush to propel the particulate material received from said sweeper brush out through an opening in said housing, an upper baffle extending between said housing side walls above said brushes having an arcuate face confronting said second brush, in spaced relation, extending toward said second brush to define a reducing throat and an outlet, a lower baffle extending between said side walls having an arcuate face confronting said sweeper brush defining an inlet throat, ground engaging wheels supporting said housing, and means rotating said sweeper brush to sweep particulate material through said inlet into said housing and rotating said second brush to propel the particulate material received from said sweeper brush through said outlet, said arcuate lower baffle extending from its lower end away from said sweeper brush to define an expanding throat limiting clogging of said housing and the space between said brushes being greater than the annular space defined between said upper baffle and said second brush to propel the particulate material received by said second brush from said housing, through said outlet.

7. The sweeper assembly defined in claim 6 characterized in that said lower baffle includes a downwardly facing arcuate lower end spaced below the rotational axis of said sweeper brush extending between said side walls and fixed relative to said housing, said arcuate lower end defining a drag surface means for lifting said sweeper assembly upon engaging an accumulation of particulate material, thereby limiting the material swept into said housing to prevent clogging.

8. The sweeper assembly defined in claim 7, characterized in that said arcuate lower baffle end is spaced below the rotational axis of said sweeper brush a distance greater than one-half the radius of said sweeper brush.

* * * * *